United States Patent [19]

Eirich et al.

[11] Patent Number: 4,562,970

[45] Date of Patent: Jan. 7, 1986

[54] APPARATUS FOR OPENING AND CLOSING THE OUTLET APERTURE OF A PROCESSING MACHINE

[76] Inventors: Walter Eirich, Spessartweg 18; Paul Eirich, Bahnhofstr. 11; Hubert Eirich, Sandweg 1, all of Hardheim, Fed. Rep. of Germany

[21] Appl. No.: 572,706

[22] Filed: Jan. 20, 1984

[30] Foreign Application Priority Data

Jan. 22, 1983 [DE] Fed. Rep. of Germany ..... 3302110

[51] Int. Cl.[4] ..... B02C 17/18

[52] U.S. Cl. ..... 241/65; 241/70; 241/79.1; 241/180; 241/284; 241/299; 241/DIG. 30

[58] Field of Search ..... 34/108, 142; 51/164.1, 51/163.1, 164.5; 366/187, 188, 192, 193; 241/65, 102, DIG. 30, 284, 285 B, 26, 285 R, 299, 300, 70, 71, 72, 171, 176–183, 79.1

[56] References Cited

U.S. PATENT DOCUMENTS 744,451 11/1903 Abbe ..... 241/180 X
1,670,005 5/1928 Pratt ..... 241/70 X

FOREIGN PATENT DOCUMENTS 0003779 5/1979 European Pat. Off. .
2099323 12/1982 United Kingdom ..... 241/70

*Primary Examiner*—Mark Rosenbaum
*Attorney, Agent, or Firm*—Paul & Paul

[57] ABSTRACT

A closure member (11) for opening and closing an outlet orifice (30) in a stationary cover (32) of a drum (1) drivable in rotation in a processing machine, in which the material being treated is conveyed upwards towards the outlet aperture, which is provided generally at the lower region of the drum. Closure member (11) is movably fitted to the cover (32) and is at least partly closable. To ensure that the material being discharged, particularly if it is heterogeneous, fibrous material, is not deposited and does not clog the discharge aperture (30), whereby the opening on the one hand and the closure member (11) on the other hand are not sensitive to contamination and caking, and to ensure that there is a desirably large outlet aperture cross-section despite the limited space available in the cover (32), the invention provides for the outlet aperture (30) to have a crescent shape, which widens in the direction of rotation (7) of the drum (1), while the closure member (11) is constructed as a closure plate, mounted at one side (at 10) on the cover (32) and connected for rotary movement to an adjustable drive (13).

13 Claims, 11 Drawing Figures

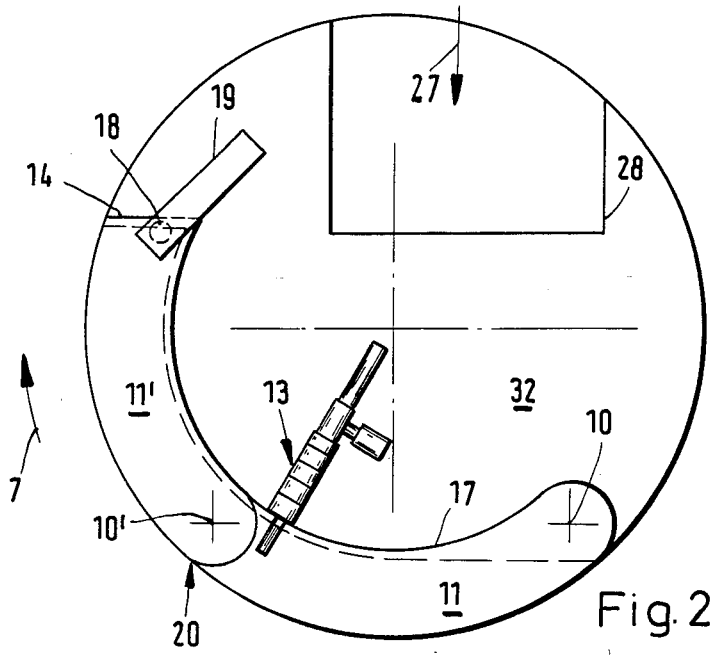
Fig. 2
Fig. 3
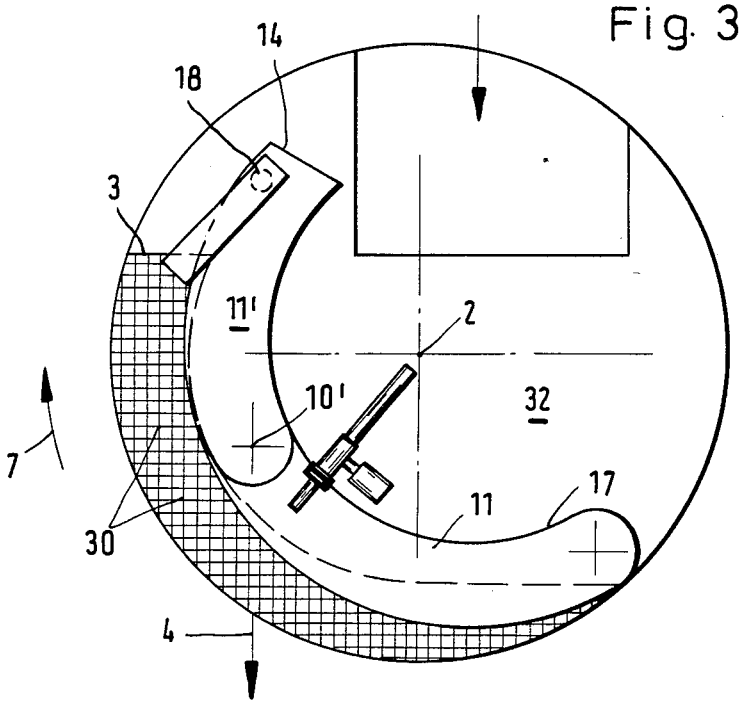

APPARATUS FOR OPENING AND CLOSING THE OUTLET APERTURE OF A PROCESSING MACHINE

The invention relates to an apparatus for opening and closing an outlet aperture provided in a stationary cover on a processing machine incorporating a rotary drum, cylinder or analogous rotor in which the material being processed is conveyed upwards relative to the outlet aperture, this being provided predominantly at a lower region of the rotor and being at least partly closable by a closure member movably fitted to the cover.

European Patent Publication No. 3 779 (Application No. 79 100 373.4) discloses a processing apparatus, in particular a comminuting apparatus, which is provided with an opening and closing device of the aforementioned type in the form of a discharge flap. This known machine has a high-speed rotor and at least one toothed disc which acts on material held on the internal wall of the rotor by the supercritical speed of the machine. However, the comminuting action is of no interest for the opening and closing device according to this invention, so that the nature and action of the comminuting means are not described in detail. It is simply stated that the supercritical speed is considered to be the number of revolutions per minute for driving the rotor, at which the centrifugal force is greater than the gravitational force acting on the particular material, so that the material is held pressed against the internal wall of the rotor.

In connection with the present invention, it is also relevant that the known machine has a stationary cover, with an inlet aperture in its upper area and, at the lower area of the rotor, in which the material being processed is conveyed upwards, an outlet orifice. The material being processed, e.g. comminuted, flows around the stationary cover to the outlet aperture and can flow through the latter, if it is open. Opening or closing takes place by means of a discharge flap hinged to the stationary cover and preloaded in the closing direction. The flap slopes in the direction of material flow and deflecting members are preferably provided in the vicinity of said flap. The deflecting members serve to guide the flowing material over slots between the discharge flap and the cover.

The known discharge flap admittedly enables a regulatable emptying of the comminuted or other processed material, even if it is textile fragments, sheets, etc. which, e.g., are obtained when comminuting domestic refuse, at acceptable effort and expenditure. However, the edges of the stationary cover at the downstream end of the outlet aperture are substantially at right angles to the direction of movement of material flow. Consequently, there is a risk, particularly with long-fibred, heterogeneous material, that the latter will be deposited on the downstream edge of the outlet aperture, so that the latter will slowly clog up, or proper closure of the discharge flap will be prevented. Furthermore, the cross-sectional size of the opening defined by the known discharge flap is not varied in direct proportion to the angular position of the flap shaft, so that automatic control of the flap position is difficult.

An aim of the present invention is therefore to provide an improved apparatus for opening and closing an outlet aperture of the aforementioned type in such a way that outflowing material, even if heterogeneous, fibrous material, is not deposited and does not clog up the outlet aperture. At the same time, the aperture on the one hand and the closure member with its drive on the other hand must desirably be resistant to pollution and caking of the material being processed. In addition, despite the limited space requirement in the stationary cover, the outlet aperture must desirably have a large cross-section.

According to the invention, this aim is achieved in that the outlet aperture widens in a crescent-shaped manner in the direction of rotation of the rotor and the closure member for said aperture is constructed as a closure plate mounted at one side on the stationary cover and displaceable via its side mounting by connection with an adjustable drive.

As a result of the crescent shape of the outlet aperture, which widens in the direction of flow of the material being processed, the aperture defines a narrow but long surface area along the edge of the stationary cover, so that although overall there is a large outflow cross-section, the major part of the generally circular cover is available for other openings, without any significant loss in surface area due to the outlet aperture. These openings consist of the inlet aperture arranged in the upper area of the cover, openings for the arrangement and drive of mixing, comminuting or other processing tools, as well as openings for fitting gas supply and discharge lines, burners, etc.

As the closure member is in the form of a plate parallel to the plane of the cover and displaceable via a mounting on one side, the outlet cross-section in the outlet aperture can be varied in proportion to the angular position of the closure member or a pivot shaft therefor, so that the additional advantage of an automatic control is obtainable.

The outlet aperture with the closure member is located in that area of the stationary cover or the rotary drum or other rotor below it, which mainly contains the material being processed, so that, on opening the closure member, said material can flow out of the drum or rotor.

The bearing point of the closure member (at which it is mounted) is preferably located in the vicinity of the narrower end of the outlet orifice. In this case, a simple operation is achievable if the closure plate is connected to the adjustable drive in a vicinity remote from the pivot bearing, e.g. the remote end. The plate-like closure member can therefore be advantageously moved by means of the adjustment member into any chosen position above the crescent-shaped outlet orifice. Through the one-sided arrangement of the pivot bearing or analogous mounting, the closure plate is moved in such a way that the opening of the outlet aperture widens in the direction of movement of the rotor. This advantageously prevents any clogging of the material flowing out of the rotor. It is particularly appropriate if the closure plate surface parallel to the stationary cover is drawn over the latter during the opening and closing movement and cleans itself with the aid of the cover plate edge. Thus, there can be no breakdowns as a result of caking up. Furthermore, the closure member will not be sensitive to contamination by deposited processed material.

In accordance with the invention, the outlet aperture is closed by a sliding movement of the plate-like closure member parallel to the stationary cover and not, as in the case of the known discharge flap, counter to the pressure of the outflowing material. Thus, there is no longer risk of jamming between the edge of the closure member and the edge of the cover as a result of clogging by the outflowing material.

The apparatus of the invention can be used with a variety of machines and equipment in which a rotary container or drum or analogous rotor is closed by a stationary cover. Such equipment consists e.g. of drum mixers, drum granulators, comminuting machines, granulating machines, cooling and drying drums, etc. In accordance with the invention, it is possible continuously to regulate the width of the outlet aperture range between the "closed" and "open" end positions.

The existence of the edge of the stationary cover on the downstream side of the outlet aperture, indicated as disadvantageous hereinbefore, is admittedly theoretically unavoidable in the case of the crescent-shaped outlet aperture according to the invention, but is now no longer of any significance, because this downstream end of the crescent-shaped outlet aperture can be positioned so high in the area of the rotary drum that the flowing material, being conveyed upwards in the drum as a result of its rotation, no longer reaches this boundary edge. Thus, the downstream boundary edge of the crescent-shaped outlet orifice according to the invention may be positioned outside the area containing the material being processed.

According to a further advantageous development of the invention, the closure member in the form of a cover plate is constructed as a one-part or multipart closure slide, analogous to a slide valve, and at least one slide is connected to the adjustable drive. Thus, the slide can be movable to any desired opening width, even if there is little space available on the stationary cover. As was stated hereinbefore, this space is required for fitting tools, the arrangement of an inlet aperture, etc. As a result of a multipart construction of the slide, its movement range is increased, without prejudice to the provision of other components on the stationary cover.

It is also advantageous if, when at least two slides are provided, the second slide is mounted in rotary manner at the end opposite to the bearing point of the first slide. This leads to the simplest possible drive for the composite slide, and the lever action of the adjustable drive is maximised. It is also advantageous to arrange a connecting guide link for the movement of the slide at the end opposite to the pivot bearing thereof. This guide acts as a guide path for a single slide or for the individual segments of a composite slide, which can be moved by means of a central drive so that the path length of movement of the individual segments increases towards the outflow. As a result of this connecting guide link, the opening movement of the downstream slide may be increased to such an extent that there is a larger opening in the vicinity thereof than would be possible through a simple radial movement of the first slide about its pivot bearing. Thus, during the opening movement, the downstream slide may rotate relative to the first slide.

Another embodiment of the invention is characterised by a hinged flap pivotally mounted on the slide by means of a flap shaft positioned on the surface of the slide. The slide movement and/or the flap movement of the cover plate can then take place with the most favourable action having regard to material characteristics.

For example, angular positioning of the hinged flap may be utilised to carry out a basic setting of the opening width, whilst the slide movement is responsible for the fine setting and control. Slide movement advantageously also leads to a self-cleansing effect on the inside of the hinged flap, so that, on closing, the disadvantage of clogging or jamming and consequently an obstacle to further movement, as with the known closure means, is no longer present. Thus, through these measures, the hinged flap can be brought into the closed position with the slide raised and only then does the slide cut in knife-like manner through the material flow, in this way completely to close the crescent-shaped outlet aperture.

The arrangement of the cover slide in accordance with the invention is particularly favourable if the slide is mounted on the outside of the stationary cover. The bearing point of the slide can then advantageously be provided with a ball and socket joint, and then the slide is preferably arranged at an angle to the stationary cover. With the aid of this ball and socket joint at the pivot bearing of the slide, both the slide movement and the flap movement can be carried out by means of a single joint.

Advantageously and according to a further feature of the invention, the slide has a wall at least partly made from an elastomeric material, preferably rubber or plastics. This is particularly advantageous in the case of treatment of light, packing products, which have to be processed in the comminuting apparatus or analogous machine. However, the upper edge of the slide, which is connected to the pivot bearing, should be made from metal, in the case of a partly rubber or plastics construction, so that the bearing and force transfer of the opening and closing movement of the slide can take place in the previously described manner and also in a stable manner, whilst the slide surface coming into contact with the material to be treated is made from the rubber or plastics.

According to yet a further feature of the invention, it is convenient if the slide is constructed as a rake or grid and is preferably at least partly heatable and/or equipped with magnets. By constructing the slide as a rake or grid, the closure member according to the invention can be simultaneously used for selective discharge of treated material from the drum. If the slide plate is heated, it is particularly easy to prevent caking. It is appropriate to equip the slide plate with magnets if, for example, ferrous or part ferrous material is to be automatically separated during emptying. The iron adhering to the slide can, every so often, be fed into special containers and stripped off by switching off the magnetic field. Stripping preferably takes place, e.g., by the complete opening of the slide, or the stripping of the iron-covered surfaces by moving past a cleaner, if permanent magnets are used.

In order to facilitate maintenance on the processing machine with the opening apparatus according to the invention, it is appropriate to jointly construct the cover and slide closure in such a way that they can be pivoted completely out of the machine.

Further advantages, features and possible uses of the present invention will be gathered from the following description of preferred embodiments, in conjunction with the accompanying drawings, in which:

FIG. 1 diagrammatically shows a plan view of a circular cover with an inlet and crescent-shaped outlet aperture;

FIG. 2 is a similar view, the closure member in the form of a slide being in two parts, and shown in the closed position;

FIG. 3 shows the same embodiment as in FIG. 2, but showing the slide in the open position;

Figure 6:
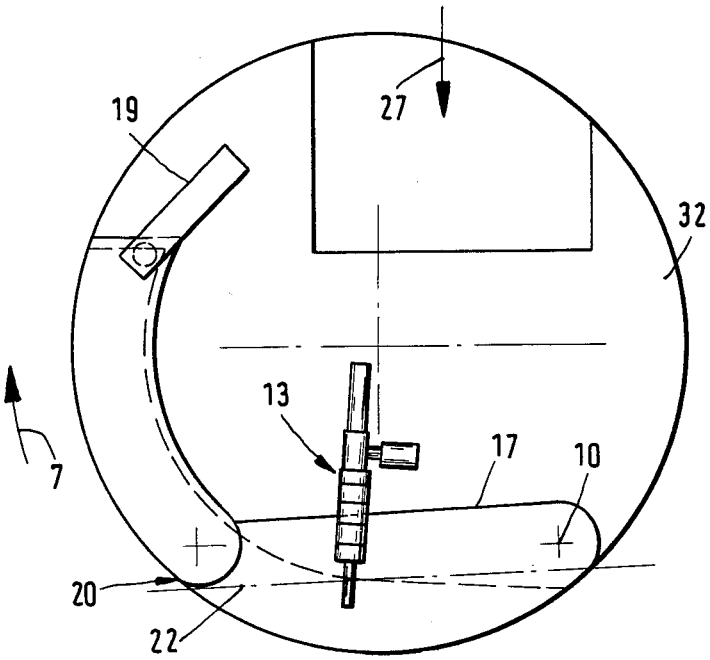
Figure 7:
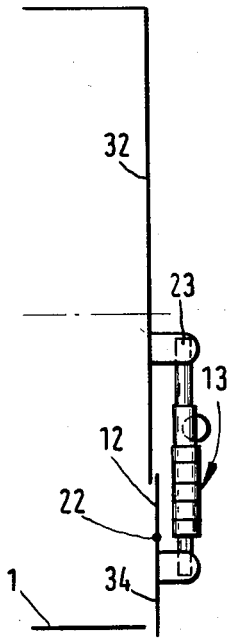
Figure 8:
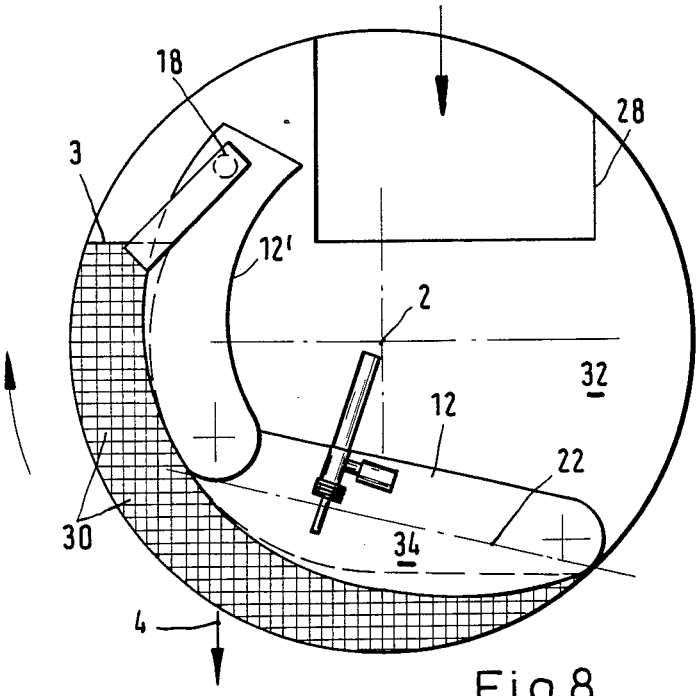
Figure 9:
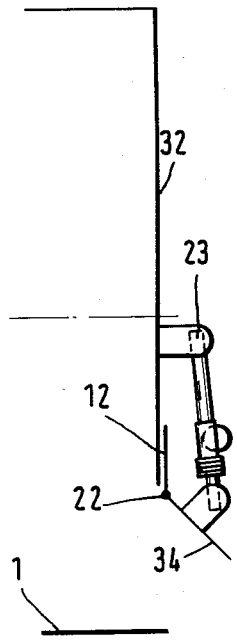
Figure 10:
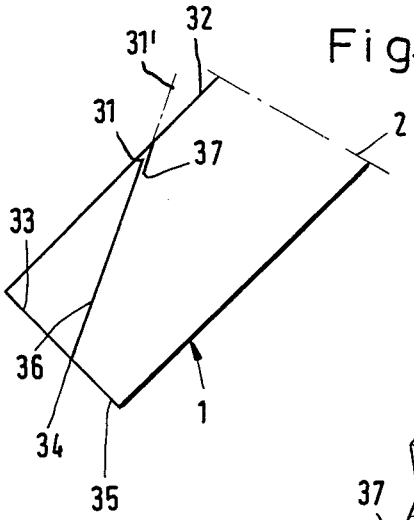
Figure 11:
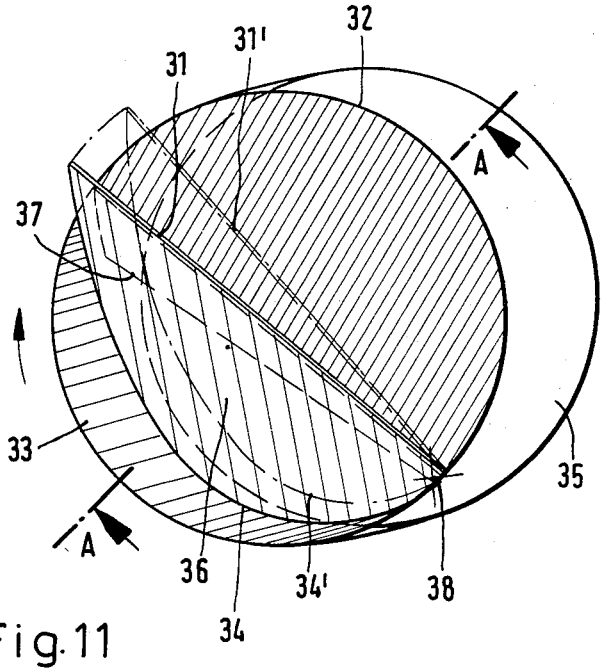

FIGS. 6 to 9 show another embodiment, having a combination of slide and flap closure, FIGS. 6 and 8 being plan views and FIGS. 7 and 9 side views, whilst FIGS. 6 and 7 show the closed position and FIGS. 8 and 9 the open position;

FIG. 10 shows, broken away and diagrammatically, the arrangement of another embodiment, having a sloping flap; and FIG. 11 is a perspective view of the flap which, as in FIG. 10, slopes towards the base of the rotor, but which also penetrates the rotor more deeply in the direction of rotation.

A feature common to FIGS. 1 to 6 and 8 is the very diagrammatic representation of a circular, stationary cover 32, below which is arranged a driven rotary drum 1, which is only visible through the crescent-shaped outlet aperture 30 in the cover. The direction of rotation of the drum is indicated by arrow 7. The circle representing the stationary cover 32 is subdivided into four quadrants, the crescent-shaped outlet aperture 30 essentially being in the third quadrant, whilst the inlet aperture 28 for the charging of the material to be treated in accordance with arrow 27, is largely in the first quadrant. The axis of rotation of the drum, which is mounted on the one side, is designated as 2, said axis sloping with respect to the horizontal. It can readily be visualised that, when axis of rotation 2 slopes by e.g. 45° to the horizontal, the material being treated is essentially located in the second and third quadrants of drum 1 and, taking account of the clockwise rotation according to arrow 7 on the circumference of the third quadrant, is conveyed upwards in decreasing quantities.

The crescent-shaped outlet aperture 30 starts in stationary cover 32 at the narrow end at the bottom right-hand side, approximately in the second third of the second quadrant, and then slowly widens in the direction of material flow to terminal edge 3, which is located in the vicinity of the boundary between the third and fourth quadrants, i.e. relatively high up in drum 1. This crescent-shaped outlet aperture 30, which is shown hatched in the open state in FIGS. 1, 3, 5 and 8, permits the outflow of treated material in the direction of arrow 4.

Figure 1:
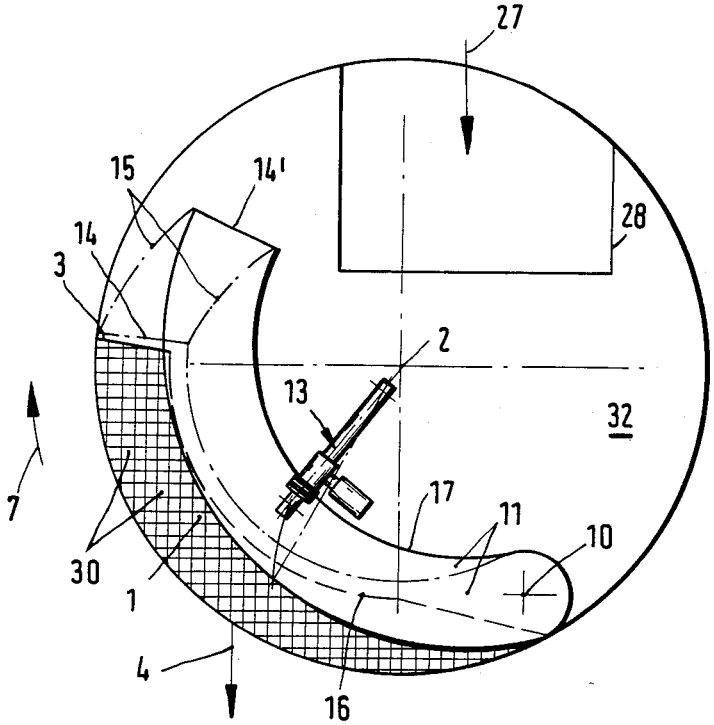

The crescent-shaped outlet aperture 30 is closable by a closure member which, in the embodiment of FIG. 1, is constructed as a cover plate articulated at one side to the bearing point 10. The cover plate is in the form of a slide 11, and acts in the manner of a slide valve. Slide 11 can be rotated about bearing 10 with the aid of adjustable drive 13, in such a way that the raised terminal edge 14 of slide 11 can be moved out of the left-hand position along radii 15 shown in FIG. 1, into the open position 14'. FIG. 1 shows the open position, so that the hatched area is seen as the crescent-shaped opening 30. Imagining the omission of slide 11, although the outlet orifice 30 is still substantially crescent-shaped, the longitudinal edge 16 running along the circumference is the broken line starting after the second third of the second quadrant and which is essentially located in the third quadrant. The longitudinal edge 17 of slide 11 is parallel to longitudinal edge 16 of outlet aperture 30. It can be seen that bearing 10 is arranged adjacent the narrow end of the outlet aperture 30 to constitute an axis of rotation for the slide 11, i.e. at the right-hand end of the aperture as seen in the drawing, in the second quadrant.

The adjustable drive 13 acts approximately in the centre or, in the case of the other embodiments, preferably at that end of slide 11 which is remote from pivot bearing 10.

In the embodiment according to FIGS. 2 and 3, the slide has a multipart, namely a two-part construction. It is also possible in these Figures to see the first slide 11 with its pivot bearing 10 and the second slide 11', whose bearing point 10' is arranged at the end opposite to the bearing pivot 10 of the first slide 11, whereat also acts the adjustable drive 13. The end of the second slide 11', with upper terminal edge 14 facing the pivot bearing 10', is connected by means of a guide roller 18 to a connecting guide link 19, so that a single central drive 13 is sufficient for moving both slides 11 and 11'. A stop member is provided at 20 at the bearing point 10' between the two slide valves 11 and 11', but is not shown as a result of the diagrammatic representation. This stop member ensures that, during the movement of the first slide 11 from the closed into the open position, the second slide 11' is moved with it. Roller 18 slides in the guide 19 during this movement.

Figure 4:
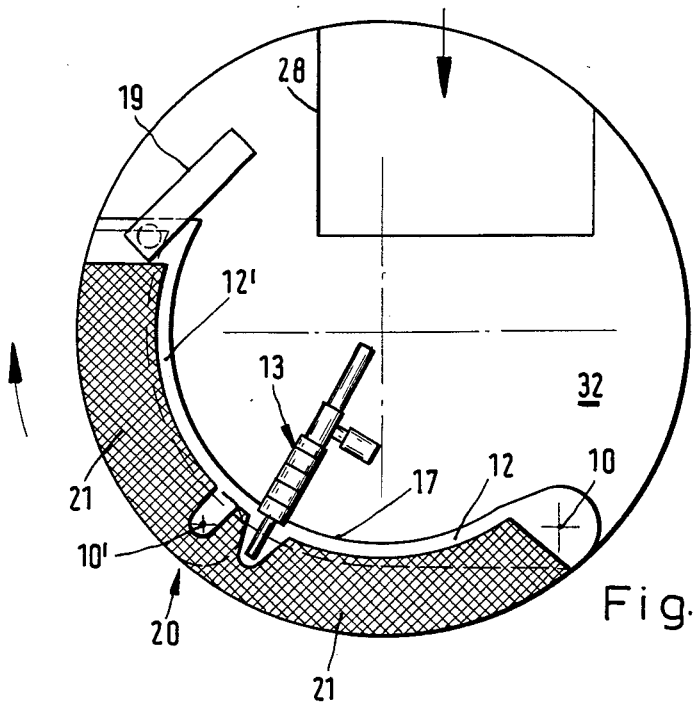
FIG. 4 shows a similar slide to FIG. 2, but which is provided with a wall of elastomeric material, in the closed position.
Figure 5:
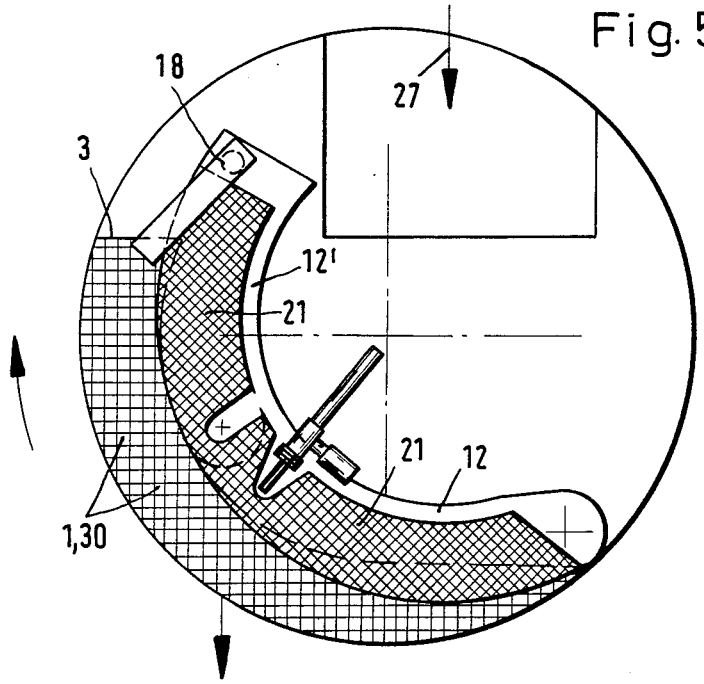
FIG. 5 is the same view as in FIG. 4, but in the open position.

FIGS. 4 and 5 show a first slide 12, which is movable on stationary cover 32 by means of pivot bearing 10, connected at its opposite end to the adjustable drive 13. The slide 12 in this case carries the pivot bearing 10' for the second slide 12'. The close-hatched area of slides 12 and 12' designates a natural or synthetic rubber wall 21, whilst a metal framework is provided above this resilient wall to ensure a stable construction of the particular slide 12 or 12'. It is also clear in this embodiment how, in direct proportion to the stroke, the adjustable drive 13 can gradually expose the crescent-shaped outlet aperture 30 from the closed position of FIG. 4 into the open position of FIG. 5.

Another embodiment of the invention is shown in FIGS. 6 to 9, where a hinged flap 34 is pivoted on the slide 12 by means of a flap shaft 22, located on the surface of said slide 12. The arrangement of flap shaft 22 and slide 12 on the outside of the cover 32 can be seen in FIGS. 7 and 8. However, the mounting of the slide 12 on the outside of the cover 32 cannot be seen in detail, due to the schematic nature of the representation. FIGS. 6 and 7 show the closed position of closure member 12, 34. By maintaining the spindle direction parallel to the cover 32, i.e. maintaining an angle of approximately 90° at the pivot axis 23 of the adjustable drive 13, the slide 12 with aligned hinged flap 34 can be raised, whilst stripping off any adhering material particles or iron particles held by magnets on the inside of the closure member 12, 34. FIG. 9 shows a partly raised position, in which the angle of 90° has already been departed from at the pivot point 23, because the hinged flap 34 has been tilted from the position of FIG. 7 into that of FIG. 9. In the plan view of FIG. 8, it is possible to see the resulting crescent-shaped outlet aperture 30. The second slide 12' moves in substantially the same manner as in the previously described embodiments.

FIG. 10 shows, in broken away, diagrammatic manner, the drum or rotor having axis of rotation 2 and stationary cover 32. Slide closure 36 is arranged to tilt within the rotary drum 1 of the processing machine. For ease of understanding, this slide has been shown as a circular segment instead of as a ring segment. FIG. 10 is a cross section through FIG. 11 on the line A—A.

In FIGS. 10 and 11 the rotary drum 1 is shown in perspective with its outside surface referenced 35 and its inside surface referenced 33. The upper part of the drum is closed by cover 32. The fulcrum 38 of the slide 36 is located at the right-hand lower edge of the cover 32.

Edges 34 and 31 define slide 36 in the closed position and edges 34' and 31' in the open position. The slide slopes in two directions. The lower region of edge 34 projects further into the rotary drum 1 than edge 31. At the side opposite to fulcrum 38, the entire height of slide 36 projects further into the drum than at the fulcrum 38.

Edge 37 is an edge of the cover 32 covered by the slide. The upper region of the cover 32 is parallel to the bottom of the rotary drum 1. At its lower edge, it is bevelled in accordance with the slope of the slide 36.

We claim:

1. In a rotationally drivable drum apparatus for processing material, wherein the drum is provided with a stationary cover at an end thereof, wherein said cover has an outlet aperture located at a generally lower region of the drum relative to a generally upward path of travel of material processed in the drum wherein the cover is provided with a movable closure member movably mounted on said cover and movable between positions opening said aperture and at least partly closing said aperture, the improvement comprising:

(a) said outlet aperture being of crescent shape and of increasing aperture size in the direction of rotation of said drum;

(b) said closure member comprising a closure plate in articulated mounting on said cover plate; and (c) adjustable drive means for pivotally moving said closure member on its said mounting about a pivot.

2. Apparatus according to claim 1, wherein the articulated mounting for the closure plate is positioned adjacent the narrow end of the outlet aperture.

3. Apparatus according to claim 1, wherein the closure plate is constructed as a slide of at least a single part and at least one slide part is connected to the adjustable drive.

4. Apparatus according to claim 3, wherein when at least two slide parts are provided, with the second slide part being rotationally mounted at the end opposite to the pivot of the first slide on the cover.

5. Apparatus according to claim 4 wherein at the end opposite to the pivot of the slide on the cover, a connecting guide link is provided for guiding the movement of the second slide.

6. Apparatus according to claim 3 wherein the pivot of the slide has a ball and socket joint.

7. Apparatus according to claim 6, wherein the slide is arranged at an acute angle to the cover.

8. Apparatus according to claim 3, wherein the slide carries a hinged flap, pivotally mounted by means of a flap shaft, located on the surface of the slide.

9. Apparatus according to claim 1, wherein the slide is mounted on the outside of the cover.

10. Apparatus according to claim 1, wherein the slide has a wall at least partly made from elastomeric material.

11. Apparatus according to claim 1, wherein the slide is constructed as a grid.

12. Apparatus according to claim 1, wherein the slide is constructed to comprise means facilitating the heating thereof.

13. Apparatus according to claim 1, wherein the slide is equipped with magnets.

* * * * *